United States Patent [19]

Lyman et al.

[11] 4,018,493

[45] Apr. 19, 1977

[54] VACUUM CLEANER HOSE END STRUCTURE

[75] Inventors: John Bartholomew Lyman, Bloomington; Bruce Edmund Stewart, Maplewood, both of Minn.

[73] Assignee: Whirlpool Corporation, Benton Harbor, Mich.

[22] Filed: Nov. 7, 1975

[21] Appl. No.: 629,843

[52] U.S. Cl. ..... 339/15; 285/7; 339/276 T

[51] Int. Cl.[2] ..... H01R 3/04

[58] Field of Search ..... 339/15, 16 R, 276 F, 339/276 T; 285/7

[56] References Cited

UNITED STATES PATENTS

| | | | |
|---|---|---|---|
| 3,034,085 | 5/1962 | Pauler et al. | 339/16 R |
| 3,636,285 | 1/1972 | Wickham et al. | 339/276 T X |

*Primary Examiner*—Roy Lake
*Assistant Examiner*—DeWalden W. Jones
*Attorney, Agent, or Firm*—Wegner, Stellman, McCord, Wiles & Wood

[57] ABSTRACT

A vacuum cleaner hose end structure having a molded end portion secured to a flexible hose portion and a hose end adaptor telescopically received in the molded end portion to define a desired hose end configuration. The hose end adaptor may comprise any one of a plurality of different configuration adaptors. The hose end adaptor further is arranged to retain an electrical connector in association with electrical terminals carried by the molded end portion of the flexible hose to provide a desired electrical terminal configuration which may be selectively male or female. The vacuum cleaner hose may be provided with such selectively arranged hose end structures at each of its opposite ends.

12 Claims, 9 Drawing Figures

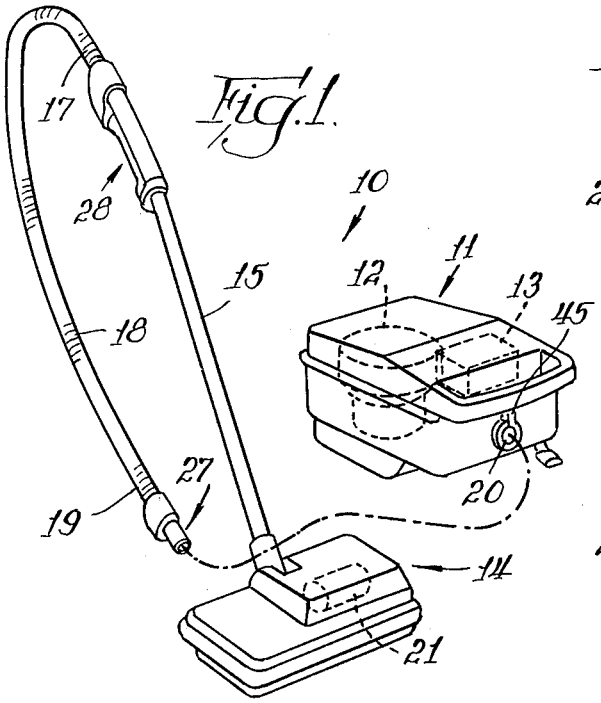
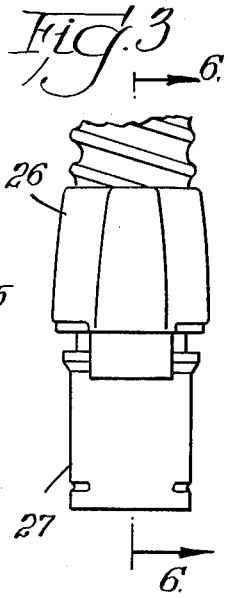
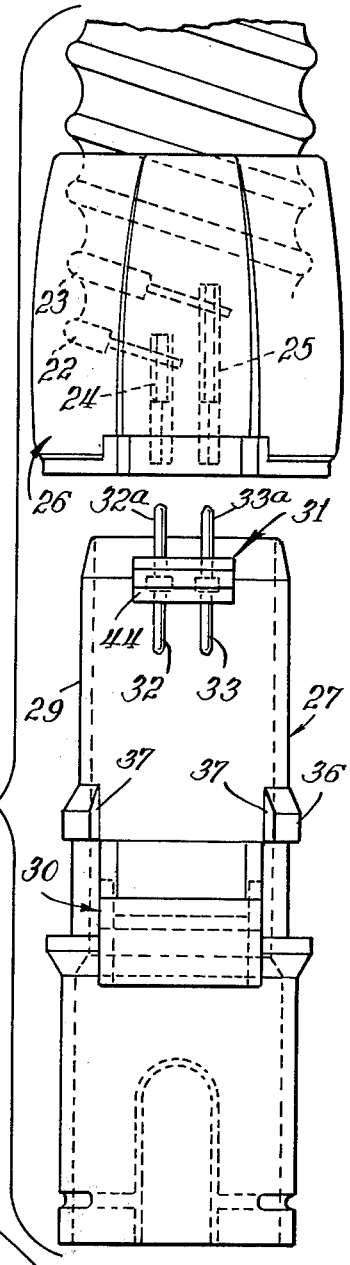
Fig. 4.
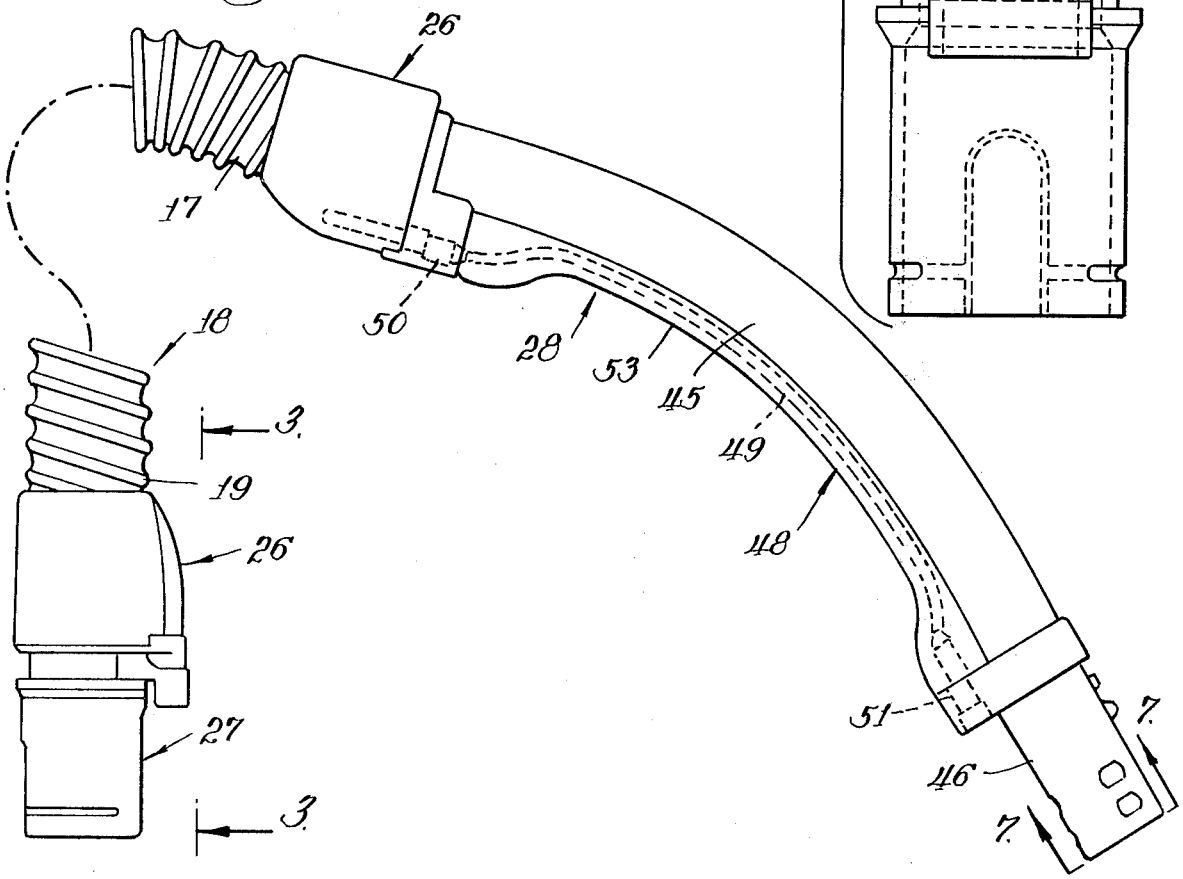

Fig. 5
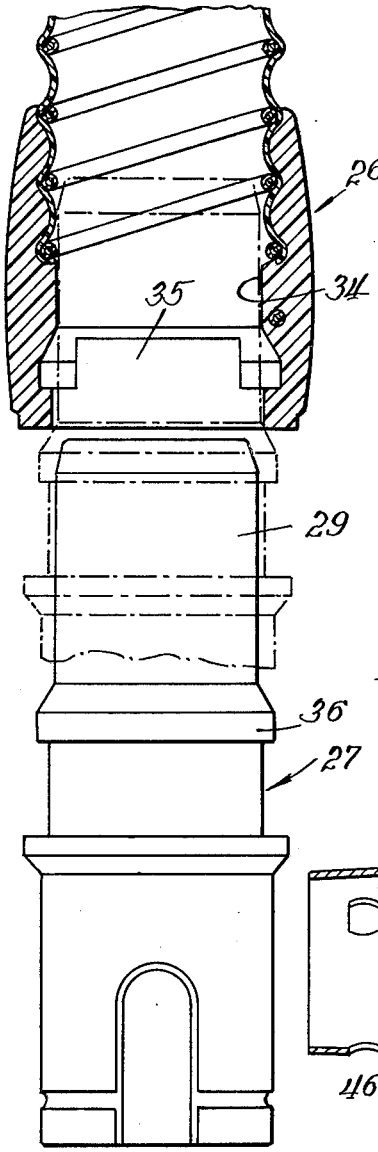
Fig. 7
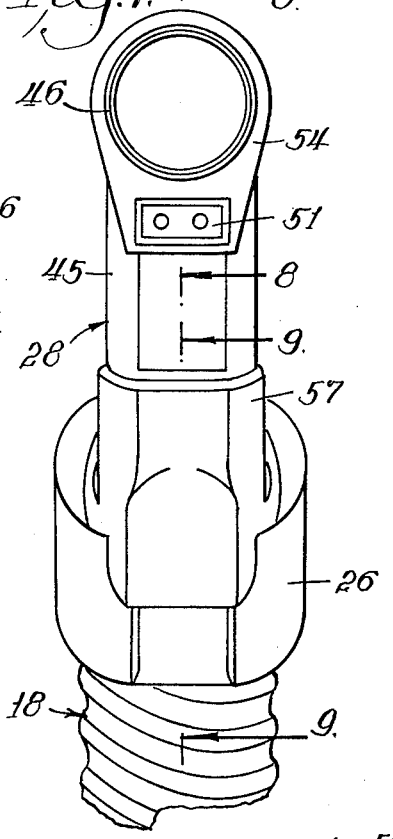
Fig. 6
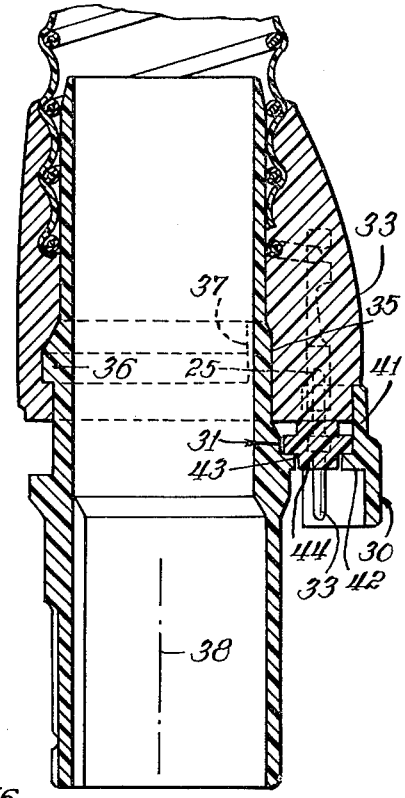
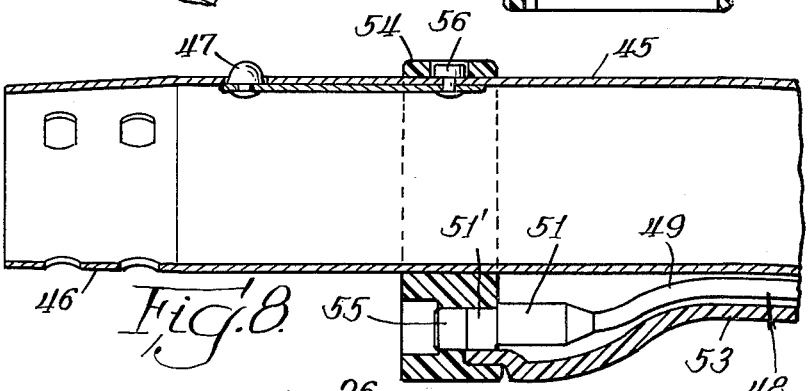
Fig. 8
Fig. 9
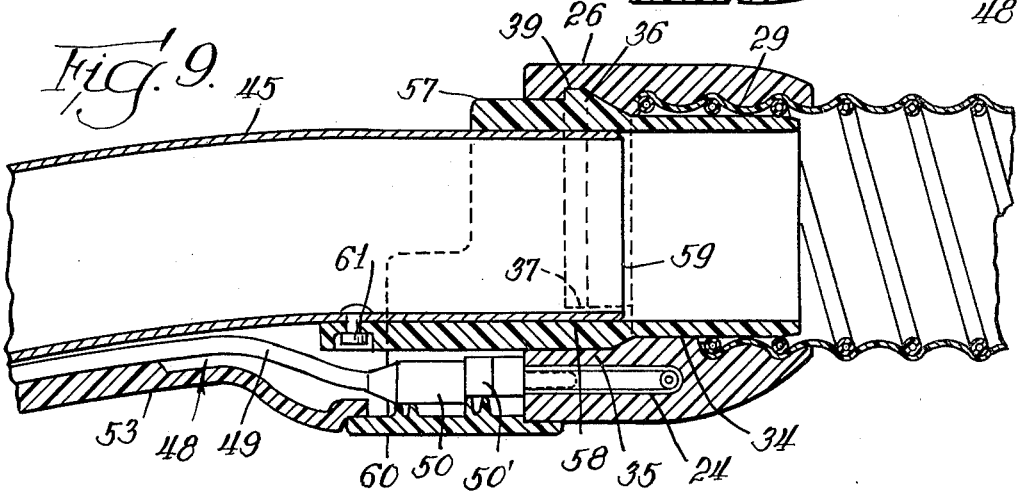

VACUUM CLEANER HOSE END STRUCTURE

BACKGROUND OF THE INVENTION

1. Field of the Invention

This invention relates to vacuum cleaners and in particular to vacuum cleaner hoses and means for providing selectively different hose end connectors on such hoses for use with opposite ends of the hose and with different configuration vacuum cleaners.

2. Description of the Prior Art

In one conventional form of vacuum cleaner, a suction unit may comprise a canister which houses a suction fan and dirt collecting means. Dirt laden air is delivered to the suction unit through a flexible hose which is connected to a floor cleaning unit by a wand. The floor unit may include electrically operable means, such as a rotary brush drive motor, and it is desirable to incorporate in the wand and flexible hose an electrical conductor means for providing electrical power from the canister to the floor unit electrical means.

The canister and wand may be provided with connector elements having any one of a plurality of different configurations and in the conventional hose constructions, hose end structures are provided which are adapted to mate with the specific connector means of the canister and wand. Such an arrangement raises the problem of mantaining a large stock of different hoses having different hose end connectors for use with the different connecting means of the different canister and floor unit structures.

The flexible hose structure is a relatively bulky structure and, thus, maintaining a stock of different specific model hose structures requires not only substantial stock space, but also presents problems in shipment and record keeping. One example of a hose end utilized in vacuum cleaner apparatus is illustrated in U.S. Pat. No. 3,727,949 of Donald L. Kleykamp et al. Therein, fittings are provided for attachment to the end of the flexible hose which are easily relatively rotatable. No electrical conducting means is associated with the hose construction.

SUMMARY OF THE INVENTION

The present invention comprehends an improved vacuum cleaner hose end construction having end means adapted for selective arrangement to fit a plurality of hose connectors having different configurations. The hose construction of the present invention utilizes a molded end portion secured to the end of the flexible hose and a hose end adaptor telescopically receivable in the molded end portion. The hose end adaptor may be any one of a plurality of adaptors having different configuration corresponding to the connector configuration to which the hose is to be connected. Thus, the hose may be provided with a standard configuration molded end portion permitting selective installation in association therewith of any one of a plurality of different adaptors to provide complete hose constructions having different connectors at its opposite ends and having a wide range of different configurations for use with a wide range of different canister and floor unit connector structures.

The end portions of the hose end structure of the present invention may incorporate electrical terminal connector means to provide further selectivety in the configuration of the hose end to accommodate the hose end to electrical connecting means of the canister and floor unit structures also as desired.

As the hose end adaptors comprise relatively nonbulky structures, a variety of different configuration adaptors may be readily stocked for adapting the basic hose structure for use with any one of a wide variety of connector structures to facilitate shipment, minimize stock recording problems, minimize stock storage space problems, and, in general, provide improved efficiency in the merchandising of such vacuum cleaner structures.

The hose end adaptors may be readily installed in the molded hose end portions without the need for tools. In the illustrated embodiment, the hose end adaptors are connected by being snapped telescopically into the molded hose end portions and are arranged to retain the electrical connector adaptor means in association with the terminal means of the molded hose end portion.

The hose end adaptor is associated with the molded end portion nonrotatively so as to prevent transmission of rotational forces to the electrical terminal means thereby reducing maintenance problems and providing facilitated assembly of the hose end structures.

BRIEF DESCRIPTION OF THE DRAWINGS

Other features and advantages of the invention will be apparent from the following description taken in connection with the accompanying drawing wherein:

FIG. 1 is a perspective view of a vacuum cleaner apparatus embodying the invention;

FIG. 2 is a broken side elevation of a hose structure thereof embodying the invention;

FIG. 3 is a fragmentary elevation taken substantially along the line 3—3 of FIG. 2;

FIG. 4 is a broken enlarged exploded view of the hose end of FIG. 3.

FIG. 5 is a view partially in diametric section illustrating the connection of the hose end adaptor of FIG. 3 to the molded end portion of the hose;

FIG. 6 is a diametric section taken substantially along the line 6—6 of FIG. 3;

FIG. 7 is a fragmentary elevation taken substantially along the line 7—7 of FIG. 2;

FIG. 8 is a diametric section taken substantially along the line 8—8 of FIG. 7;

FIG. 9 is a diametric section taken substantially along the line 9—9 of FIG. 7.

DESCRIPTION OF THE PREFERRED EMBODIMENT

In the exemplary embodiment of the invention as disclosed in the drawing, a vacuum cleaner apparatus generally designated 10 is shown to comprise a canister 11 provided with a motor operated suction means 12 and a dirt collecting means 13 to which dirt laden air is drawn by the suction means from a floor unit generally designated 14. The floor unit includes a wand 15 which is attached to one end 17 of a flexible hose 18. The opposite end 19 of the hose is arranged to be connected to a connector 20 on the canister 11. The floor unit may be provided with an electrical device, such as a rotary brush drive motor 21, requiring the provision of electrical power to the floor unit. The present invention comprehends the provision of a hose 18 which carries suitable electrical conductors 22 and 23 for providing the electrical energy to motor 21 from the canister electrical circuitry.

The invention more specifically comprehends the provision of electrical terminals 24 and 25 on the ends of the conductors 22 and 23 disposed within molded end portions 26 of the hose. The hose end portions 26 are similar in each of hose ends 17 and 19 and, thus, the end structure permanently secured to opposite ends of the hose 18 is similar. The invention, however, comprehends that different means be associated with the permanently secured end structures to provide hose ends having any one of a plurality of different configurations for selective connection to any one of a plurality of different configurated connectors 20 and wand 15. As shown in FIG. 2, one form of hose end adaptor generally designated 27 may be associated with the molded end portion 26 at one end of the flexible hose 18 and another form of hose end adaptor generally designated 28 may be associated with the other molded end portion 26 at the opposite end of hose 18.

The different configuration hose end adaptors may be installed on the hose ends as desired. In each of the different hose end adaptor configurations, an inner end portion is provided which is adapted to mate with the hose end portion 26 for securing the adaptor to the molded hose end portion in sealed air flow association therewith.

Referring to FIGS. 3 through 6 illustrating hose end adaptor 27, terminals 24 and 25 in molded hose end 26 comprise female terminals and electrical connector 31 comprises a double-ended male adaptor providing exposed male terminals 32 and 33. Hose end adaptor 27 includes a portion 29 for securing the adaptor to molded hose end 26. Adaptor 27 also ncludes retainer portion 30 for retaining electrical connector 31 in association with terminals 24 and 25.

The invention comprehends the provision of a non-rotatable association of the hose end adaptor with the hose end portion 26 so as to provide a guided association of the adaptor relative to the molded hose end portion 26 in aligning the terminals of connector 31 with the terminals 24 and 25 during installation of the hose end adaptor to the hose end portion 26 and to prevent transmission of rotational forces subsequently between the terminals during use of the hose. More specifically, as shown in FIGS. 4, 5 and 6, hose end portion 26 defines a generally cylindrical socket 34 receiving the inner end portion 29 of the hose end adaptor 27. The socket defines an arcuate key 35 projecting radially inwardly and the hose end adaptor defines an inner annular flange 36 which is cut away at 37 to embrace the key and thereby prevent rotation of the hose end adaptor about the axis 38 of the hose end portion 26. Flange 36 is received in a complementary arcuate slot 39 in hose end portion 26, as shown in FIG. 6. Thus, as seen in FIGS. 5 and 6, the adaptor portion 29 is telescopically inserted into the hose end portion 26 until the flange 36 snaps into the slot 39 thereby effectively positively locking the adaptor to the end portion 26. Resultingly, the end portion 26 is permanently mounted to the end of the flexible hose for receiving any one of a plurality of different hose end adaptors in rotationally fixed airtight secured relationship.

As discussed above, the electrical connector 31 may comprise a separate element which is retained in electrical contact association with terminals 24 and 25 by a retainer portion 30 of the adaptor 27. Retainer portion 30 includes a wall 42 provided with an opening 43 exposing a shoulder 44 of the electrical connector 31. Male terminals 32 and 33 extend outwardly through shoulder 44 for engagement by the complementary electrical connector means of the associated connector, such as electrical connector means 45 associated with connector 20 of canister 11, as shown in FIG. 1. Retainer portion 30 also includes an axially extending wall 41 which forms a shroud enclosing terminals 32 and 33 in their connected association with terminals 24 and 25 and with connector 45 associated with canister 11. As illustrated in FIGS. 4 and 6, the electrical connector 31 includes inwardly extending male terminal portions **32*a* and 33*a* adapted to be received in electrical contact with terminals 24 and 25 in the assembled relationship of the adaptor and molded hose end 26. As the connector shoulder 44 is fitted into the housing opening 43, the telescoping of the adaptor portion 29 into the hose end 26, as controlled by the key 35, automatically aligns the electrical adaptor terminals 32*a* and 33*a* with the hose end terminals 24 and 25** for facilitated assembly. Further, as the key prevents rotation of the adaptor relative to the hose end after it is telescoped thereinto, rotational forces are prevented from being transmitted between the adaptor and hose end terminals.

Referring now to FIGS. 2, 7, 8 and 9 illustrating hose end adaptor 28, adaptor 28 forms a handle for facilitated manipulation of hose 18 by the operator of the vacuum cleaner and a means to connect the hose 18 to a floor unit wand 15. Adaptor 28 includes a curved tube 45 having an end 46 designed to be connected to wand 15. Tube end 46 includes a conventional push button latch 47 for retaining tube 45 in operative association with wand 15.

A cord and plug assembly 48 is provided to connect conductors 22 and 23 of hose 18 to a suitable cord associated with wand 15, not shown. Cord and plug assembly 48 includes a cord 49, a male plug 50 positioned adjacent molded end 26 for connection with terminals 24 and 25, and a female plug 51 positioned adjacent end 46 of tube 45. Plug 51 is adapted to be connected to a suitable connector 52 supported adjacent the end of wand 15.

Cord and plug assembly 48 is mounted in association with tube 45 by a cord cover 53 forming a channel enclosing cord 49 along tube 45. The end of cord cover 53 adjacent end 46 of tube 45 is retained by cord cover lock 54. Cord cover lock 54 includes a recess 55 receiving and supporting plug 51 in operative position adjacent tube end 46. Shoulders 51' on plug 51 cooperate with cord cover 53 and cord cover lock 54 to retain plug 51 in its operative position. Cord cover lock 54 is affixed to tube 45 by means of a fastener such as a rivet 56.

The end of cord cover 53 opposite tube end 46 is retained by tube adaptor 57. Tube adaptor 57 has an inner end portion 29 like end portion 29 of hose end adaptor 27. End portion 29 includes a flange 36 received in slot 39 of molded end 26. As at the opposite end of hose 18, molded end 26 includes an arcuate key 35 which cooperates with cut away portion 37 of flange 36 to prevent rotation of tube adaptor 57 relative to molded end 26. Tube adaptor 57 includes a wall 60 supporting plug 50 and retaining the distal end of cord cover 53. Plug 50 includes shoulders 50' cooperating with wall 60 to retain plug 50 in its operative position. Tube end 59 is received in socket 58 of tube adaptor 57 and retained in operative association with tube 45 by means of a suitable fastener such as rivet 61. As hose end adaptor 28 is assembled with an end 26 of hose 18, the telescoping of adaptor portion 29 into hose end 26 is controlled by the key 35, thereby automatically aligning the terminals of plug 50 with hose end terminals 24 and 25 for facilitated assembly. Further, as the key prevents rotation of the adaptor relative to the hose end after it is telescoped thereinto, rotational forces are prevented from being transmitted between the hose end adaptor and hose end terminals.

As the adaptors 27 and 28 may be snapped into the desired telescoped relationship with the molded hose end without the need for tools, the assembly of the hose end structure herein is extremely simple and economical and may be accomplished either in a sub-assembly operation, or as necessary by servicing personnel in the field.

Molded hose ends 26 are the subject of co-pending Lyman patent application, Ser. No. 629,842 (PA-4861-O-VC-USA) entitled "Vacuum Cleaner Hose End With Electrical Terminals" filed on Nov. 7, 1975 with this application and assigned to the assignee of this application. The electrical connector 31 is the subject of co-pending Westergren patent application, Ser. No. 629,844 (PA-4863-O-VC-USA), entitled "Vacuum Cleaner With Replaceable Terminals," filed on Nov. 7, 1975 with this application and assigned to the assignee of this application.

The foregoing disclosure of specific embodiments is illustrative of the broad inventive concepts comprehended by the invention.

Having described the invention, the embodiments of the invention in which an exclusive property or privilege is claimed are defined as follows:

1. In a vacuum cleaner hose having a flexible duct portion, and electrical conductor wires co-axially helically carried by said duct portion, an improved hose end structure comprising:

a molded end portion on the end of said hose duct portion, the end of said wires being disposed in said molded end portion;

first terminal means carried in said molded end portion, said terminal means being connected to said end of the wires, said terminals having a portion exposed outwardly of said molded end portion;

a hose end adaptor having a first end telescopically positioned in said molded end portion and a second, opposite end extending outwardly of said molded end portion;

second terminal means positioned by said adaptor in electrical contact engagement with said first terminal means; and cooperating interlock means on said molded end portion and said hose end adaptor preventing rotational forces tending to cause relative coaxial rotation between said hose end adaptor and said molded end portion from being transmitted to said terminal means.

2. The vacuum cleaner hose structure of claim 1 wherein said hose end adaptor includes means for preventing separation of said second terminal means from said first terminal means.

3. The vacuum cleaner hose structure of claim 1 wherein said interlock means further defines means for preventing longitudinal separation of said hose end adaptor from said molded end portion.

4. The vacuum cleaner hose structure of claim 1 wherein said first terminal means comprises female terminal means and said second terminal means defines an exposed male terminal means.

5. The vacuum cleaner hose structure of claim 1 wherein said hose end adaptor defines a retainer portion, said second terminal means being received in said retainer portion and defining terminals exposed to outwardly of said retainer portion.

6. The vacuum cleaner hose structure of claim 1 wherein said interlock means positions said hose end adaptor longitudinally on said hose duct end portion suitably to retain said second terminal means in said electrical contact engagement with said first terminal means.

7. The vacuum cleaner hose structure of claim 1 wherein said hose end adaptor first end underlies said first terminal means.

8. The vacuum cleaner hose structure of claim 1 wherein said interlock means comprises snap-lock means permitting insertion of any one of a pluraity of different hose end adaptors to be selectively connected to said hose duct end portion.

9. In a hose for a canister vacuum cleaner having a flexible duct portion and electrical conductor wires coaxially helically carried by said duct portion, an improved hose end structure comprising:

molded end portions on the ends of said hose duct portion, the end of said wires being disposed in said molded end portions;

first female terminal means carried in said molded end portions, said terminal means being connected to said end of the wires, said terminals having a portion exposed in an axial end plane of said molded end portions;

a tubular hose end adaptor having a first end telescopically positioned in one of said molded end portions and having a second, opposite end extending outwardly of said molded end portion and adapted for connection to the inlet of said canister vacuum cleaner;

second terminal means positioned by said tubular hose end adaptor in electrical contact engagement with said first terminal means and including exposed male terminal means adapted for connection to said canister vacuum cleaner upon connection of said tubular hose end adaptor second portion to said canister vacuum; and cooperating interlock means on said one molded end portion and said tubular adaptor preventing rotational forces tending to cause relative coaxial rotation between said tubular hose end adaptor and said one molded end portion from being transmitted to said terminal means and for preventing longitudinal separation of said tubular hose end adaptor from said one molded end portion.

10. The canister vacuum cleaner hose of claim 9 including a second hose end adaptor having a first end telecopically positioned in the other of said molded end portions and having a second opposite end forming a curved manipulating handle for said hose and having a connector portion adapted to be selectively attached to a floor unit wand; a cord and plug assembly attached to said second hose end adaptor including a first plug positioned by said second hose end adaptor in electrical engagement with said first terminal means of the other of said molded end portions, and a second plug positioned by said second hose end adaptor adjacent said connector portion for connection to complementary terminals attached to said floor unit wand.

11. In a vacuum cleaner hose having a flexible duct portion, and electrical connector wires coaxially helically carried by said duct portion, an improved hose end structure comprising: an end portion on the end of said hose duct portion, the end of said wires being disposed in said end portion; first terminal means carried on said end portion, said terminal means being connected to said end of the wires; a tubular end adaptor having a first end telescopically positioned in said hose duct end portion and a second, opposite end extending outwardly of said end portion; second terminal means positioned by said adaptor and being in electrical contact engagement with said first terminal means; and cooperating interlock means on said hose duct end portion and said hose end adaptor preventing rotational forces tending to cause relative coaxial rotation between said hose end adaptor and said end portion from being transmitted to said terminal means.

12. The vacuum cleaner hose structure of claim 1 wherein said interlock means comprises a key molded integrally with said molded end portion, and means on said adaptor first end for embracing said key.

* * * * *

UNITED STATES PATENT AND TRADEMARK OFFICE

CERTIFICATE OF CORRECTION

PATENT NO. : 4,018,493
DATED : April 19, 1977
INVENTOR(S) : John Bartholomew Lyman and Bruce Edmund Stewart It is certified that error appears in the above–identified patent and that said Letters Patent are hereby corrected as shown below:

Column 5, Claim 2, line 59, after "claim" cancel "1" and substitute therefor --11--.

Column 5, claim 3, line 63, after "claim" cancel "1" and substitute therefor --11--.

Column 5, claim 4, line 67, after "claim" cancel "1" and substitute therefor --11--.

Column 6, claim 5, line 3, after "claim" cancel "1" and substitute therefor --11--.

Column 6, claim 6, line 8, after "claim" cancel "1" and substitute therefor --11--.

UNITED STATES PATENT AND TRADEMARK OFFICE

CERTIFICATE OF CORRECTION

PATENT NO. : 4,018,493

DATED : April 19, 1977

INVENTOR(S) : John Bartholomew Lyman and Bruce Edmund Stewart

It is certified that error appears in the above-identified patent and that said Letters Patent are hereby corrected as shown below:

Column 6, claim 7, line 14, after "claim" cancel "1" and substitute therefor --11--.

Column 6, claim 8, line 17, after "claim" cancel "1" and substitute therefor --11--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*